US010914309B1

(12) United States Patent
Rivers

(10) Patent No.: US 10,914,309 B1
(45) Date of Patent: Feb. 9, 2021

(54) EXPANDABLE HAND-HELD FAN HAVING NOISE MAKING MEANS INTEGRATED THEREON

(76) Inventor: Dannie Rivers, Oakland Park, FL (US)

( * ) Notice: Subject to any disclaimer, the term of this patent is extended or adjusted under 35 U.S.C. 154(b) by 549 days.

(21) Appl. No.: 12/713,378

(22) Filed: Feb. 26, 2010

(51) Int. Cl.
*F04D 25/08* (2006.01)
*A45B 27/00* (2006.01)

(52) U.S. Cl.
CPC ..... *F04D 25/086* (2013.01); *A45B 27/00* (2013.01)

(58) Field of Classification Search
CPC ..... A45B 27/00; F04D 25/084; F04D 25/086
USPC ..... 416/70 R, 73, 142, 71, 70 A; 446/397
See application file for complete search history.

(56) References Cited

U.S. PATENT DOCUMENTS 257,058 A * 4/1882 North ..... A47J 43/1093 416/70 R
555,339 A * 2/1896 Rubin ..... F04D 25/08 416/54
835,433 A * 11/1906 Hulsizer ..... 416/73
902,633 A * 11/1908 Wigand et al. ..... A45B 27/00 416/73
1,478,399 A * 12/1923 Rothschild ..... A45B 27/00 416/71
D266,969 S * 11/1982 Pope ..... D3/4
D312,529 S * 12/1990 Routt ..... D3/3
D339,384 S * 9/1993 Seifan ..... D21/411
D365,440 S * 12/1995 Stokesberry, Jr. ..... D3/3
5,980,205 A * 11/1999 Sue ..... A45B 27/00 416/70 A
D469,601 S * 2/2003 Scalise ..... D3/3
D469,950 S * 2/2003 Scalise ..... D3/3
7,347,670 B1 * 3/2008 Henderson ..... A45B 27/02 416/70 A
2010/0227528 A1 * 9/2010 Weiss et al. ..... 446/397

FOREIGN PATENT DOCUMENTS

JP 3164806 U * 12/2010

* cited by examiner

*Primary Examiner* — Richard A Edgar
(74) *Attorney, Agent, or Firm* — The Law Firm of Andrea Hence Evans, LLC

(57) ABSTRACT

The expandable hand-held fan having noise making means integrated thereon comprises a fan that when folded shut resembles a miniature baseball bat. Upon extending the fan, advertising indicia is printed thereon, and may be associated with sports team, logo, etc. The fan includes noise making means upon the fan, and produces noise upon movement of air across the noise making member.

10 Claims, 4 Drawing Sheets

EXPANDABLE HAND-HELD FAN HAVING NOISE MAKING MEANS INTEGRATED THEREON

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of hand held fans, more specifically, a hand held fan that expands and retracts and of which includes noise making means upon said fan.

B. Discussion of the Prior Art

As a preliminary note, it should be stated that there is an ample amount of prior art that deals with hand held fans. As will be discussed immediately below, no prior art discloses a hand held fan that expands and retracts to reveal the fan, which when retracted resembles a baseball bat, which includes logo information upon said fan, and of which further includes noise making means upon said fan such that when said fan is waved back and forth noise is generated via air passing across said noise generating means.

The Henderson Patent (U.S. Pat. No. 7,347,670) discloses an interchangeable folding hand fan. However, the fan does not resemble a baseball bat when folded shut, and of which does not include noise making means integrated into the fan such that upon movement of the fan, noise is produced.

The Sue Patent (U.S. Pat. No. 5,980,205) discloses a folding hand fan. Again, the fan does not resemble a baseball bat when folded shut, and of which does not include noise making means integrated into the fan such that upon movement of the fan, noise is produced.

The North Patent (U.S. Pat. No. 257,058) discloses a hand fan that folds. However, when the fan folds shut, said fan does not resemble a bat and of which include noise making means into the fan along with advertising indicia located upon said fan.

The Rubin Patent (U.S. Pat. No. 555,339) discloses a folding fan structure. Again, the fan does not resemble a baseball bat when folded shut, and does not include advertising indicia upon said fan or noise generating means into said fan.

The Pan Patent (U.S. Pat. No. 902,633) discloses a hand held fan in the simulated shape of a baseball bat. Though the fan resembles a bat when the fan is in a closed state, said fan does not include noise-making means into said fan blade.

The Routt Patent (U.S. Pat. No. Des. 312,529) illustrates an ornamental design for a sports fan, which does not depict a fan that folds shut to resemble a bat and of which includes noise making means upon said fan.

The Seifan Patent (U.S. Pat. No. Des. 339,384) illustrates an ornamental design for a top with a handle and a football-shaped noise maker, which does not resemble a baseball bat when said fan is folded shut.

The Scalise Patent (U.S. Pat. No. Des. 469,601) illustrates an ornamental design for a hockey stick fan, which does not resemble a baseball bat.

The Pope Patent (U.S. Pat. No. Des. 266,969) illustrates an ornamental design for a fan in the simulated shape of a baseball glove, which does not resemble a baseball bat.

The Stokesbury, Jr. Patent (U.S. Pat. No. Des. 365,440) illustrates an ornamental sports fan with a team logo, which does not resemble a baseball bat when folded shut or include noise making means upon said fan.

While the above-described devices fulfill their respective and particular objects and requirements, they do not describe a hand held fan that expands and retracts to reveal the fan, which when retracted resembles a baseball bat, which includes logo information upon said fan, and of which further includes noise making means upon said fan such that when said fan is waved back and forth noise is generated via air passing across said noise making means. In this regard, the expandable hand-held fan having noise making means integrated thereon departs from the conventional concepts and designs of the prior art.

SUMMARY OF THE INVENTION

The expandable hand-held fan having noise making means integrated thereon comprises a fan that when folded shut resembles a miniature baseball bat. Upon extending the fan, advertising indicia is printed thereon, and may be associated with a sports team, logo, etc. The fan includes noise making means upon the fan, and produces noise upon movement of air across the noise making means.

It is an object of the invention to provide an expandable fan that when folded shut or closed will resemble a baseball bat. However, it shall be noted that the resemblance of a baseball bat may be scaled down from an actual baseball bat or to scale with a miniature baseball bat.

A further object of the invention is to provide an expandable fan that can include advertising indicia upon the fan itself.

A further object of the invention is to provide advertising indicia on the fan itself, which includes a sports team name, sports player, or logo.

A further object of the invention is to provide a noise making means upon said fan, which generate noise upon movement of air through the noise making means.

These together with additional objects, features and advantages of the expandable hand-held fan having noise making means integrated thereon will be readily apparent to those of ordinary skill in the art upon reading the following detailed description of presently preferred, but nonetheless illustrative, embodiments of the expandable hand-held fan having noise making means integrated thereon when taken in conjunction with the accompanying drawings.

In this respect, before explaining the current embodiments of the expandable hand-held fan having noise making means integrated thereon in detail, it is to be understood that the expandable hand-held fan having noise making means integrated thereon is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the expandable hand-held fan having noise making means integrated thereon.

It is therefore important that the claims be regarded as including such equivalent construction insofar as they do not depart from the spirit and scope of the expandable hand-held fan having noise making means integrated thereon. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
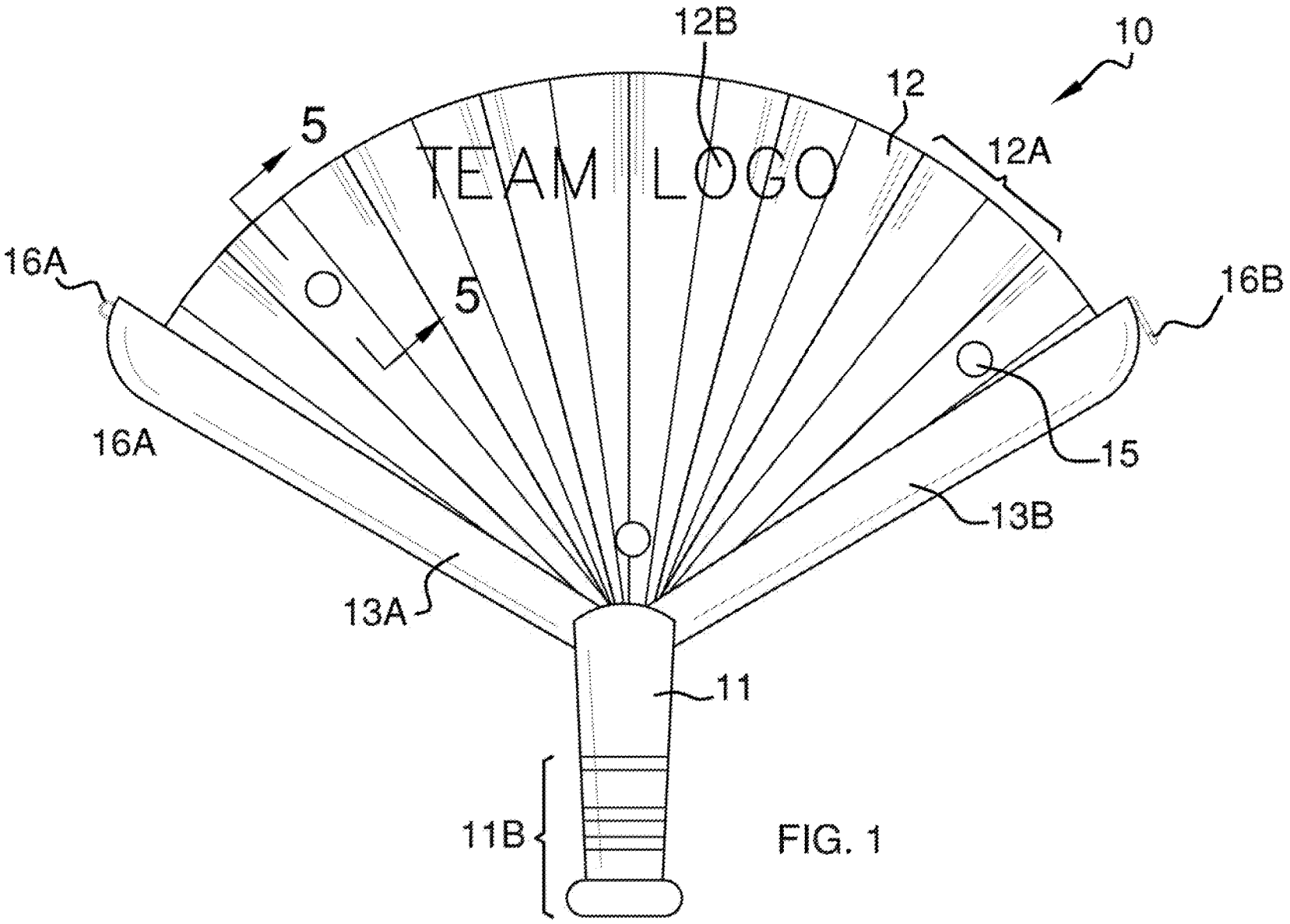
FIG. 1 illustrates a front view of the expandable hand-held fan having noise making means integrated thereon, wherein the fan is in an expanded state.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-5. An expandable hand-held fan having noise making means integrated thereon 10 (hereinafter invention) includes a handle 11, an expandable fan 12, and a cover 13.

The cover 13 includes a left piece 13A and a right piece 13B. Both the left piece 13A and the right piece 13B rotate about a hinge 14A and 14B, respectively, which are attached to a top end 11A of the handle 11. Notwithstanding the expandable fan 12, the left piece 13A and the right piece 13B can rotate about the hinge 14 to a closed state (see FIG. 2). When in said closed state (see FIG. 2), the invention 10 resembles a baseball bat.

A bottom end 11B of the handle 11 is contoured to resemble both the knob as well as the grip of a baseball bat. The cover 13 resembles the body of the baseball bat that is used to strike a baseball.

The cover 13 and the handle 11 are made of a material comprising a metal, plastic, carbon fiber, or wood.

The expandable fan 12 attaches via an attaching means along a left and right side to the left piece 13A and the right piece 13B of the cover 13, respectively. The attaching means comprises adhesive, stitching, or molding of the two parts together. The expandable fan 12 is of lightweight construction, and made of a material comprising a woven fabric, plastic, or paper.

Figure 2:
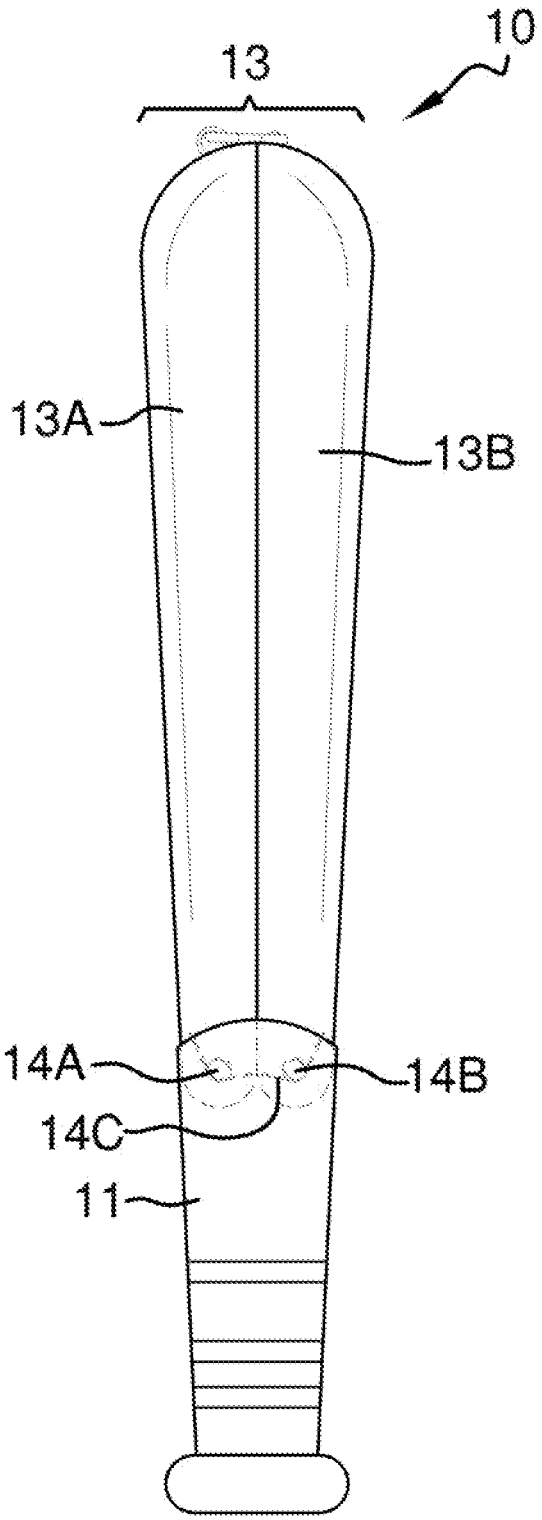
FIG. 2 illustrates a front view of the expandable hand-held fan having noise making means integrated thereon, wherein the fan is in a retracted state.

The expandable fan 12 has a plurality of creases 12A integrated into the expandable fan 12, such that the expandable fan 12 can be folded into a closed state and be contained within the cover 13 (see FIG. 2). Located on either a front surface or a rear surface of the fan 12 is an advertising indicia 12B, which depicts the words "TEAM LOGO." It shall be noted that the advertising indicia 12B may comprise a sports team name, a sports team logo, an athlete's name, event sponsor, or sporting goods manufacturer, etc. It shall be important to note that the advertising indicia 12B may be not legible until the expandable fan 12 is extended (see FIG. 1).

A plurality of noise making means 15 are integrated into the design of the expandable fan 12. The noise making means 15 generate noise upon passage of air across the noise making means 15 (se FIG. 5) in as much the same manner as a whistle, which is well known in the art. However, it shall be noted that the noise generated by the noise making means 15 is only accomplished upon fanning or moving the expandable fan 12. The location of the noise making means 15 shall be predetermined in order to account for the plurality of creases 12A.

It shall be noted that the expandable fan 12 can collapse into a closed state or be expanded for use as a fan. The expandable fan 12 expands on its own accord via the hinges 14A and 14B, which are both spring-loaded as designated by a spring 14C.

However, the expandable fan 12 may involve hinges 14A and 14B that are not spring-loaded, and wherein is expanded for use as a fan, it is important to note that an end user will need to grab both the handle 11, the left piece 13A, and the right piece 13B about the hinges 14 in order to hold the expandable fan 12 open.

A securing means 16 is included and comprises a clasp 16A and a hook 16B mounted atop the left piece 13A and the right piece 13B, respectively. The securing means 16 insures that the left piece 13A and the right piece 13B are secured together to form a baseball bat shape.

Figure 3:
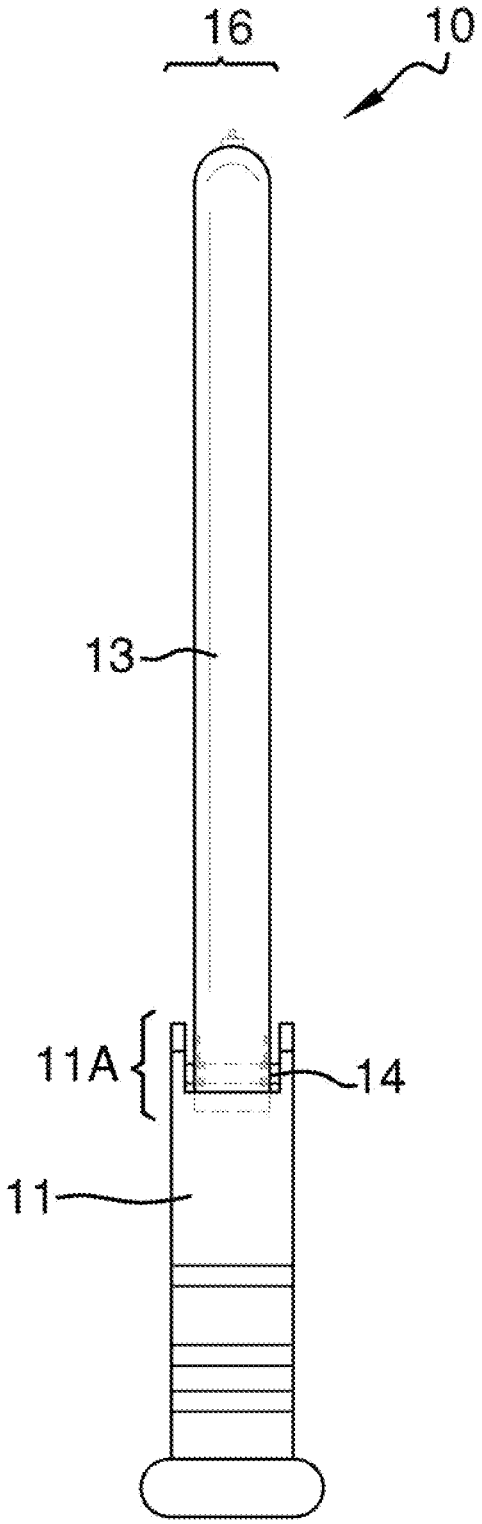
FIG. 3 illustrates a side view of the expandable hand-held fan having noise making means integrated thereon.
Figure 3A:
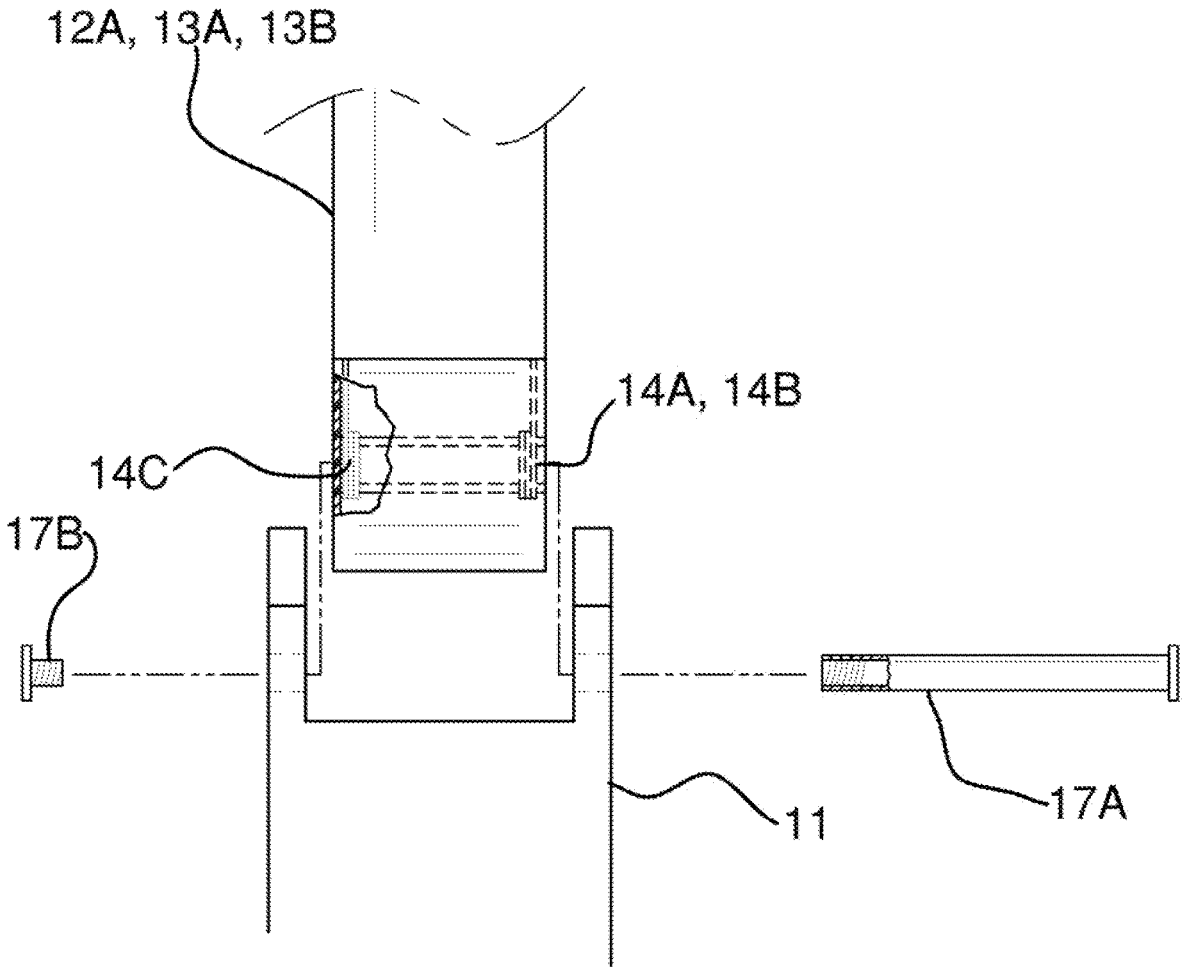
FIG. 3A illustrates an alternative embodiment of the expandable hand-held fan wherein the fan can be removed from the handle by removal of a threaded pin and screw that otherwise secure the fan onto the handle.
Figure 4:
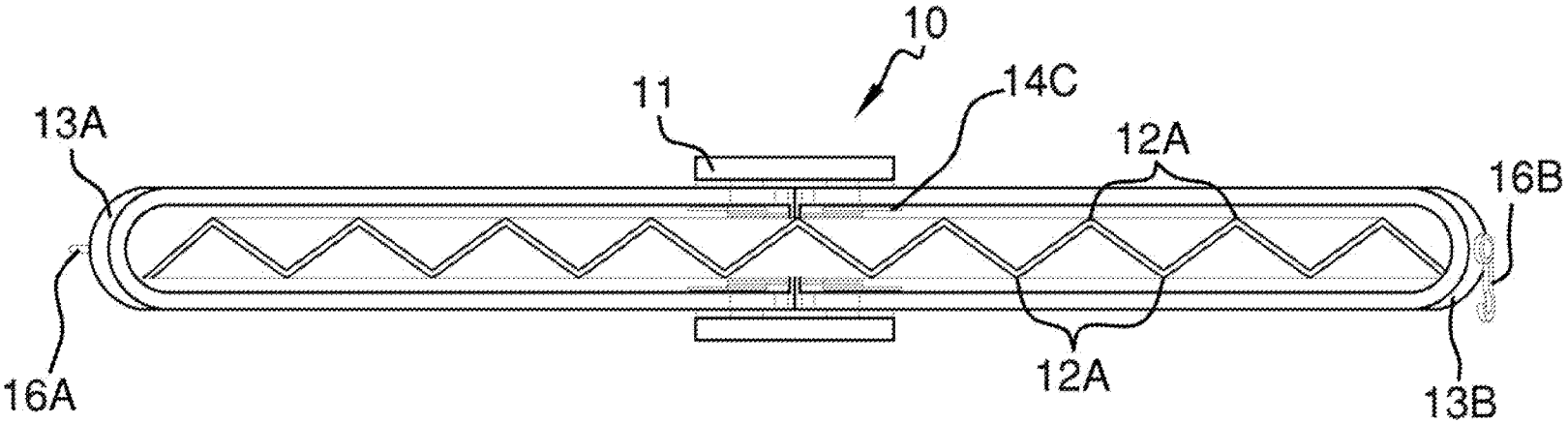
FIG. 4 illustrates a top view of the expandable hand-held fan having noise making means integrated thereon, wherein the fan in an expanded state.
Figure 5:
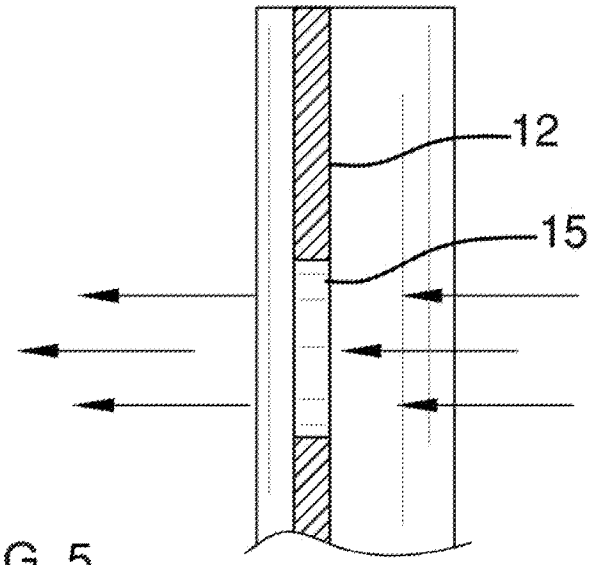
FIG. 5 illustrates a cross-sectional view along line 5-5 in FIG. 1 of the expandable hand-held fan having noise making means integrated thereon, and detailing air passing across the noise generating means.

Referring to FIG. 3A, the invention 10 may be disassembled to remove the expandable fan 12A and the cover 13 from the handle 11. Disassembly of the expandable fan 12A and the cover 13 provides for ease in cleaning of the expandable fan 12A. A threaded pin 17A and threaded screw 17B would connect the expandable fan 12A and cover 13 to the handle 11 whereby the hinges 14A and 14B are of hollow construction.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A fan device configured to transition from an open configuration to a closed configuration, the fan device comprising:

a detachable cover comprising:

a first member, a second member, and a first hinge and a second hinge each comprising a spring wherein the spring of the first hinge is configured to bias rotation of the first member around the first hinge and the spring of the second hinge is configured to bias rotation of the second member around the second hinge, wherein the detachable cover resembles a baseball bat in the closed configuration; and an expandable fan coupled to the first member and the second member of the detachable cover wherein the expandable fan comprises a plurality of whistles, wherein at least one whistle is oriented at a predetermined region of the expandable fan; and a handle coupled to the first member by a first fastener and coupled to the second member by a second fastener.

2. The fan device of claim 1, wherein the expandable fan comprises a plurality of creases and is configured to transition to the closed configuration by a folding along the plurality of creases.

3. The fan device of claim 1, wherein the detachable cover is configured to encompass the expandable fan in the closed configuration.

4. The fan device of claim 1, further comprising a hook and a clasp configured to maintain the fan device in the closed configuration.

5. The fan device of claim 1, wherein the handle comprises: metal, plastic, carbon fiber, or wood.

6. The fan device of claim 1, wherein the expandable fan comprises a woven material, plastic or paper.

7. A fan device configured to transition from an open configuration to a closed configuration, the fan device comprising:

a cover comprising:

a first member, a second member, and a first hinge and a second hinge each comprising a spring, wherein the spring of the first hinge is configured to bias rotation of the first member around the first hinge and the spring of the second hinge is configured to bias rotation of the second member around the second hinge, and wherein the cover resembles a baseball bat in the closed configuration;

a handle coupled to the first member and the second member;

a securing device comprising a hook and a clasp, and configured to maintain the fan device in the closed configuration, wherein the hook is coupled to the first member and the clasp is coupled to the second member; and an expandable fan coupled to the first member and the second member, wherein the expandable fan comprises a plurality of whistles, wherein the plurality of whistles are oriented at predetermined regions of the expandable fan.

8. The fan device of claim 7, wherein the expandable fan is coupled to at least one of the first member and the second member by: adhesive, stitching, or molding.

9. The fan device of claim 7, wherein the expandable fan further comprises indicia spanning the surface area of the expandable fan.

10. The fan device of claim 7, wherein the expandable fan comprises a plurality of creases and is configured to transition to the closed configuration by a folding along the plurality of creases.

* * * * *